US007021859B2

(12) United States Patent
Airikkala et al.

(10) Patent No.: US 7,021,859 B2
(45) Date of Patent: Apr. 4, 2006

(54) METHOD FOR SLOWING THE PROGRESS OF A VEHICLE

(76) Inventors: Pentti Juhani Airikkala, 2 Beaufort Place, Bray Maidenhead, Berks SL62BS (GB); Niko Juhani Airikkala, French Farm, Hurley Lane, Hurley, Berks, SL6 5LL (GB)

( * ) Notice: Subject to any disclaimer, the term of this patent is extended or adjusted under 35 U.S.C. 154(b) by 0 days.

(21) Appl. No.: 11/053,502

(22) Filed: Feb. 8, 2005

(65) Prior Publication Data

US 2005/0169705 A1 Aug. 4, 2005

Related U.S. Application Data

(62) Division of application No. 10/282,945, filed on Oct. 28, 2002.

(51) Int. Cl.
*E01C 11/24* (2006.01)

(52) U.S. Cl. ..... 404/72

(58) Field of Classification Search ..... 404/2, 404/6, 10, 15, 72; 188/382
See application file for complete search history.

(56) References Cited

U.S. PATENT DOCUMENTS

| | | | | |
|---|---|---|---|---|
| 206,130 | A | 7/1878 | Phinney | 404/2 |
| 459,754 | A | 9/1891 | King | 404/2 |
| 775,791 | A | 11/1904 | Austin | 404/2 |
| 1,355,833 | A | 10/1920 | Howe | 404/2 |
| 1,707,574 | A | 4/1929 | Rothmann | 404/2 |
| 2,082,429 | A | 6/1937 | Sterns | 404/2 |
| 2,112,663 | A | 3/1938 | Chantland | 404/2 |
| 3,572,465 | A | 3/1971 | Olson | 188/377 |
| 3,877,681 | A | 4/1975 | Humphrey | 256/64 |
| 3,880,541 | A | 4/1975 | McDowell et al. | 404/74 |
| 4,362,424 | A | 12/1982 | Barber | 404/6 |
| 4,366,846 | A | 1/1983 | Curati, Jr. | 141/1 |
| 5,957,616 | A | 9/1999 | Fitch | 404/6 |

OTHER PUBLICATIONS

Sly Park Recreation Area, California, Overall Map.*
www.esprittriathlon.com, 'Festival du Triathlon du Montréal', course map.*
www.grandprix.com.au/forms/circuitmap_online.html, '2004 Australian Grand Prix Circuit Map', detail of track section between turns 7 and 9.*
www.allf1.info/tracks/melbourne.
www.f1-tickets-online.com/race_australia.htm.
www.mcgillcrew.com/invitational.html.page.

* cited by examiner

*Primary Examiner*—Gary S. Hartmann
(74) *Attorney, Agent, or Firm*—Robert W. J. Usher

(57) ABSTRACT

A safety apparatus for stopping vehicles which depart from the side of a track, has a pool of liquid which extends along and to the side of the track. The pool increases in depth with increasing distance from the track up to a predetermined maximum depth. A crash barrier stops any vehicle which fails to be arrested by the liquid. The pool can be filled and emptied using a pump. A layer of gravel in the pool can be substituted as the vehicle arrest medium by pumping the pool empty. Different depth of liquid can be selected, using the pump. The liquid is preferred to be water, which can be found from rainwater runoff from the track. Such runoff can be pumped away. The invention can be used on both sides of a track.

21 Claims, 1 Drawing Sheet

METHOD FOR SLOWING THE PROGRESS OF A VEHICLE

RELATED APPLICATION

This application is a divisional of Ser. No. 10/282,945, filed Oct. 8, 2002, from which priority is claimed, the disclosure of which is incorporated herein by reference.

FIELD OF THE INVENTION

The present invention relates to safety apparatus for slowing and, hopefully, arresting) the progress of a vehicle which has left a carriageway on which the vehicle is intended to move. It particularly relates to such apparatus intended to minimise damage to the vehicle and nearby objects and injury to occupants and bystanders. Most particularly, the invention relates to such apparatus for use in vehicle racing circuits, but which is also applicable to roadways and aircraft runways.

The term "track" is hereinafter defined as any designated path required to be followed by a vehicle while moving on wheels.

BACKGROUND OF THE INVENTION

Vehicle racetracks are used for car and motorcycle racing at speeds in excess of 350 Km/hr. At such speeds, even a minor suspension or tyre failure can cause a vehicle to leave the track with considerable forward and transverse speed. Should a throttle jam open, the result is even more spectacular. Small amounts of water or oil on the track can also be catastrophic.

Not all vehicles that depart a track are irretrievably lost to a race. Many vehicles can return to the track to continue a race. The present invention seeks to provide a vehicle arresting apparatus, which is more effective in transfer of kinetic energy, and less damaging to the vehicle than prior art solutions, thereby to enable a higher proportion of arrested vehicles to return to a race track or the proper carriageway.

It is a feature of racing vehicles that ground clearance is kept to a minimum to reduce drag and increase aerodynamic partial vacuum adhesion to the racing track. Wheel intrusion beyond the lower surface of the body is very small.

Prior art includes the provision of gravel (or other aggregate) beds adjacent to a track so that a vehicle has its wheels retarded by imparting kinetic energy to the individual particles of gravel or aggregate, Unfortunately, because of the low vehicle body to ground clearance, the wheels hardly penetrate the gravel or aggregate and the vehicle tends to skim over the surface of the gravel or aggregate on the underside of its body. The size of the gravel or aggregate bed has to be made disproportionately long and wide to ensure dissipation of all longitudinal and transverse kinetic energy. The present invention seeks to provide means for arresting a vehicle where dimensions of the arresting medium are kept to a minimum, without loss of effect and minimising vehicular damage.

When in the arresting medium, the slowing vehicle can cast up large amounts of the medium in the direction of travel, which is, generally, in a direction away from the track. The kinetic energy of such ejected material is considerable. Gravel and aggregate can be hurled in the direction of spectators, track officials and nearby objects, causing damage and injury. An equal hazard appears when an undamaged, arrested vehicle seeks to return to the track.

Low friction and wheel spin can cast up material, not only away from the track, but also in the direction of oncoming vehicles. Ejected matter can lie on the track. The present invention seeks to provide apparatus where such potentially damaging ejection of material is avoided, thereby permitting the spectators to be nearer to the track without loss of protection.

Flying solid particles can injure the driver or other occupants of the vehicle. This is especially true if the vehicle should overturn. The present invention seeks to minimise injury to vehicle occupants.

A vehicle, which is damaged upon leaving a track, requires track service vehicles and equipment to recover the crashed vehicle and provide any medical or fire service attention that may be required. Gravel and aggregate impede access to the crashed vehicle and are further churned up by their progress. The present invention seeks to provide a vehicle arrest apparatus, which readily allows service vehicles access to the crashed vehicle.

When a vehicle has been arrested by gravel or aggregate, the arresting medium requires maintenance before it is in a correct condition to receive a further vehicle. Gravel and aggregates require to be retrieved and re-distributed. Such maintenance is hazardous during a race, requires partial road closure for an ordinary roadway, and is costly long-term. The present invention seeks to eliminate the need for such maintenance and to provide vehicle-arresting apparatus which instantly returns to a state of readiness to arrest a further vehicle.

Vehicle race tracks cater for all types of vehicles. Some types of vehicle, notably motorcycles, respond best to being arrested using a gravel or aggregate arresting medium, while others respond best to being arrested according to the present invention. The present invention seeks to provide an apparatus which can rapidly and automatically be converted to use of a gravel or aggregate arresting medium, thereby avoiding delays and labour costs between different sorts of track events.

SUMMARY OF THE INVENTION

The present invention comprises an apparatus for slowing the progress of a vehicle which has departed a track with a component of velocity transverse to the direction of the track, said apparatus comprising: a pool of liquid beside the track; said pool extending in the direction of the track and extending transversely to the direction of the track; said pool comprising a shaped base; said liquid being contained within said base; said base being shaped for said liquid to increase in depth with increasing transverse distance from the track for at least an initial portion of the distance from the track; and the extent of said pool being sufficient in said direction parallel to the track and the extent of said pool being sufficient in the direction transverse to the direction of the track to slow a vehicle within said pool when a vehicle engages said liquid.

The invention further provides that the liquid has a predetermined maximum depth, the maximum depth being sufficiently shallow to allow powered movement of an upright vehicle in the pool and sufficiently shallow to prevent drowning of a driver in an overturned vehicle.

The invention also provides, for preference, that the predetermined maximum depth is in the range 20 cm to 40 cm.

The invention further provides a crash barrier to prevent a vehicle exiting the pool in the event that the vehicle has failed transversely to be stopped within the pool.

The invention further provides that the base can comprise an impermeable membrane adjacent to the surface of a depression in a substrate, the depression being of substantially the same shape and dimensions as the pool, and can further comprise a hard layer, covering the membrane, the hard layer being of sufficient strength to support vehicles in the pool.

The invention further provides that, for preference, the membrane can include a butyl rubber membrane and that the hard layer can be a concrete layer.

The invention further provides a pump for altering the amount of the liquid in the pool.

The invention, yet further, provides a layer of particulate material resting on the hard layer and submerged beneath the liquid when the pool is full, the pump being operative to empty the liquid from the pool to permit the apparatus to employ the particulate material as a vehicle arresting medium in preference to the liquid.

The invention further provides that the pump is operative to introduce liquid into the pool.

The invention further provides that, for preference, the particulate material is gravel.

The invention, yet further, provides that the liquid is water, which can contain one or more additives to lower the freezing point of the water and can contain one or more additives to prevent biological growth in the water.

BRIEF DESCRIPTION OF THE DRAWINGS

The invention is further explained, by way of an example, by the following description, taken in conjunction with the appended drawings, in which.

PARTICULAR DESCRIPTION

Figure 1:
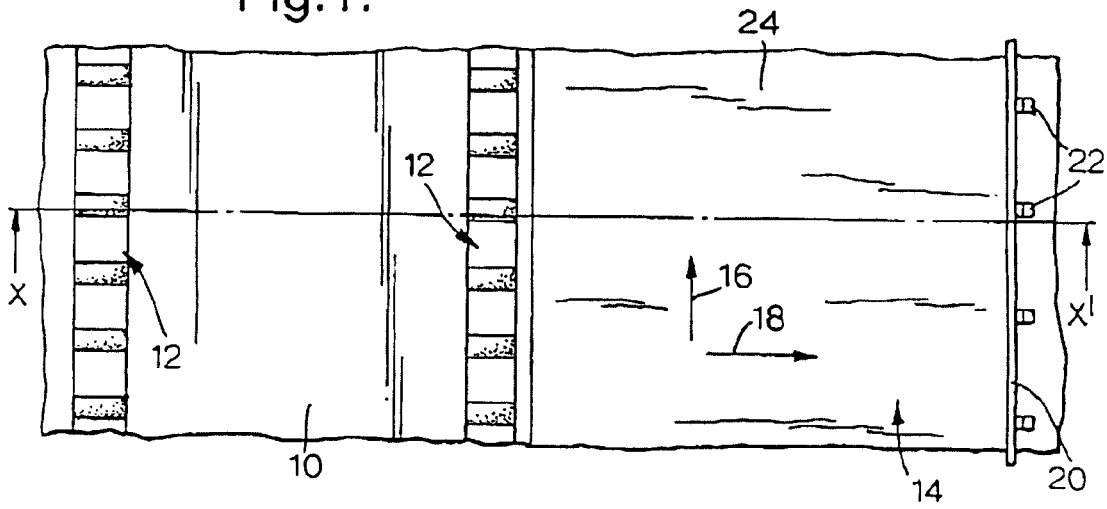
FIG. 1 is a plan view of an embodiment of the invention.

Attention is first drawn to FIG. 1. A vehicle track 10 is provided on either side with a rumble strip 12 which serves to warn the driver of a vehicle, by sound and vibration, that the vehicle is about to leave the track 10 in a direction transverse to the direction of the track 10. A pool 14 of liquid 24 is provided beside the track 10 and extends in the direction of the track 10, as indicated by a first arrow 16, and extends in a direction transverse to the direction of the track 10, as indicated by a second arrow 18. A crash barrier 20 supported on posts 22 is disposed spaced from the track 10, in the direction transverse to the direction of the track 10, at the edge of the pool 14 which is furthest from the track 10. The extent of the pool 14, in the direction 16 of the track 10, here shown truncated, and its extent in the direction 18 transverse to the direction 16 of the track 10, are each sufficient to ensure that a vehicle leaving the track 10 will, in the majority of circumstances, be brought to a halt before the vehicle reaches the crash barrier 20, by the vehicle being slowed by the arresting medium which, in this instance, is the liquid 24, which forms the pool 14. The minimum extent of the pool in the direction 18 is preferably one vehicle length, typically 4 metres or more. The maximum extent is unlimited, but in practice is unlikely to exceed 40 or 50 metres for racetracks.

Figure 2:
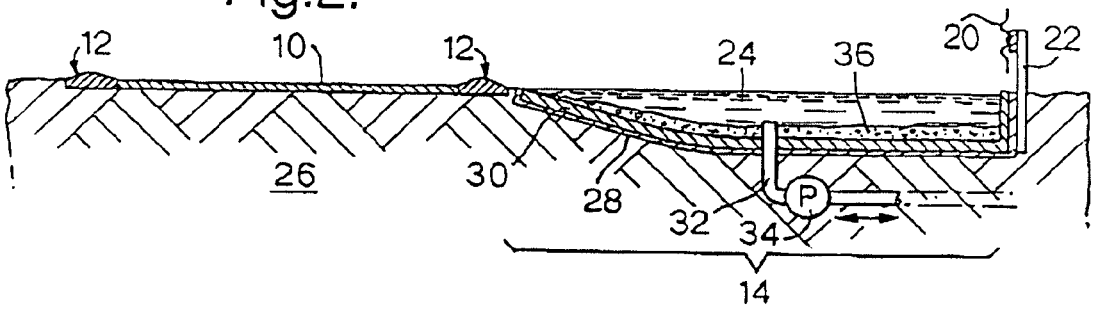
FIG. 2 is a cross-sectional view of FIG. 1, taken along the line X–X', looking in the direction of the arrows.

Attention is now drawn to FIG. 2, which is a cross-sectional view of FIG. 1, taken along the line X–X', looking in the direction of the associated arrows.

The track 10 is generally flat, but may be cambered on curves. The track is supported on a substrate 26, which, in this instance, is subsoil. The rumble strips 12 are shaped to urge a departing vehicle back onto the track 10. In the event that the vehicle departs from the track 10, despite the rumble strips 12, it enters the pool 14.

The pool 14 is shaped, and a base is formed by creating a depression in the substrate 26 substantially of the shape same as the intended shape of the pool 14. An impermeable membrane 28 is placed onto the surface of the depression in the substrate 26, together with any cushioning layers such as soft sand, to prevent small sharp objects puncturing the membrane 28 in much the same way that one would create a garden pond. For preference, the membrane 28 is a butyl rubber membrane, which is resilient, and which is readily and cheaply available as domestic pond lining material. The invention, however, provides that the membrane 28 can be any material, which is impervious to the liquid 24 and can form a resilient seal between the pool 14 and the substrate 26.

A hard layer 30 is then placed onto the membrane 28. The purpose of the hard layer 30 is to prevent a vehicle from damaging the membrane 29 when it enters the pool 14, and is of sufficient strength to support a vehicle, preventing the vehicle from stretching and distorting the membrane 28 and altering the shape of the pool 14. The combination of the hard layer 30 and the membrane 28 imparts an advantage in terms of maintenance of the pool 14. The hard layer 30 can, initially, also be impervious to the liquid 24. Repeated engagement by a vehicle with the pool 14 might, eventually, crack the hard layer 30. If the membrane 28 were not present, the liquid 24 would then be free to drain into the substrate 26. Cracks do not necessarily harm the mechanical action of the pool 14. The combination of membrane 28 and hard layer 30 thus avoid the need for maintenance.

In the example shown, the hard layer 30 is made by applying a layer of concrete on to the membrane 28 and allowing it to set. The invention is not limited to this material. The hard layer 30 can be of any mechanically strong material. Alternates include plastic resin, pre-shaped concrete or resin forms, tiles, and bricks. These may be applied singly or in combination.

The pool 14 is shaped in the direction 18, transverse to the track 10, to start at small or zero depth of the liquid 24 at the edge proximate to the track, and, at least for an initial portion of the pool's 14 extent in the direction 18 transverse to the direction 16 of the track 10, steadily to increase in depth. This allows a vehicle, which might quickly recover from leaving the track 10, to be able to steer back onto the track 10 with minimal arresting action from the liquid 24. However, the further the vehicle gets from the track 10, the greater the arresting effect of the liquid 24 as the wheels and then the body of the vehicle are progressively immersed in the liquid 24, which absorbs the kinetic energy of the vehicle. Being a liquid 24, there is little or no damage either to the suspension or to the body of the vehicle. The surface of the liquid 24 readily parts to permit the vehicle deeper ingress. Any liquid 24, which is thrown up as a vehicle is arrested, is in the form of droplets or a breaking wave. Liquid is soft, and any that happens to pass beyond the crash barrier 20 should be harmless to humans, animals and equipment there beyond.

In the example shown, the pool 14 is shown as being of constant depth as it approaches the crash barrier 20. This, however, is just one option under the invention. The pool 14 can level out towards the crash barrier 20, or can taper upwards towards the crash barrier 20.

The pool 14 has a predetermined maximum depth for the liquid 24. In this example, the track is a vehicle racing track, which may be used for purpose built racing cars such as open wheel cars, sports cars or saloon cars, or such other cars as may be driven on track days. In this circumstance, the preferred maximum depth of the liquid 24 depth is 20 cm to 40 cm, with greatest preference for 20 cm. This depth is chosen with various criteria in mind. Firstly, the liquid 24 must be deep enough sufficiently to arrest the vehicle, but not so deep that unacceptably high forces are imparted to the vehicle, causing damage to the vehicle and large deceleration forces to any occupants. Secondly, if a vehicle is arrested before it encounters the crash barrier 20, and is still upright, the liquid 24 must not be so deep that continued functioning of the vehicle engine is impaired. Air intakes and exhausts must be clear. The upright arrested vehicle can then leave the pool 14 under its own power and perhaps rejoin the track 10 to continue with a race. Thirdly, should a vehicle overturn, the depth of the liquid 24 should not be so great that the nose and mouth of a trapped (perhaps, unconscious) driver or other occupant are immersed in the liquid, bringing a distinct risk of drowning. Fourthly, should emergency vehicles or personnel be required to attend a stricken racing vehicle or occupant, the depth of the liquid 24 should not offer excessive resistance to movement of an emergency vehicle or personnel at the lower speeds used by emergency vehicles and personnel. Emergency vehicles, personnel and equipment should have clear and rapid access to a stricken racing vehicle.

The pool 14, in an extension of the embodiment, is provided with a pipe 32 and a pump 34. In this example, the pipe 32 is shown as having its inlet in the hard layer 30 on the bottom and at the deepest point of the pool 14, and the pump 34 is shown buried beneath the bottom of the pool 14. The invention also permits the pipe 32 to be fed from the edge of the pool 14 (in the form of a hose or other fixed pipe skirting or resting on the surface of the hard layer 30) and the pump 34 to be mounted adjacently to the pool 14 or remotely from the pool 14. Any arrangement of pipe 32 and pump 34, which permits operation as hereinafter described, lies within the invention.

The pump 34 and the pipe 32 are operative to fill the pool. The pump 34 connects to a reservoir or tank (not shown) of liquid 24 which can be proximate to the pool 14, remote from the pool 14, or, indeed, be another similar pool 14. The pump 34 permits simple, automatic maintenance of the depth of liquid 24 in the pool 14.

The pump 34 can also extract liquid 24 from the pool 14. If, for any reason, the maximum depth of liquid 24 requires to be adjusted up or down, say, for example, for maintenance, or to accommodate the larger stopping forces needed for such events as truck tractor unit racing, adjustment can easily be achieved by adding or subtracting liquid 24 to or from the pool 14. When employed by an aircraft runway, the depth can be adjusted for different types of aircraft, so as not to exceed the fragility of a particular model of aircraft. In aircraft runways, the invention also envisages that the crash barrier 20 can be omitted.

In racing circles, it is considered that motorcycles are fragile. Personal preference also plays a part. A motorcycle rider is exposed to extreme risk, and may choose not to be stopped by a liquid 24 in the fear that, having come off his machine, he will not be supported and might drown. The machine also lies down on its side and will be choked by the liquid 24 and thus be incapable of further use. It is considered that gravel is the only acceptable means for arresting motorcycles.

The invention provides a solution in the form of a gravel layer 36, laid on the hard layer 30 at the bottom of the pool 14. When a racing event requires a gravel arresting medium, the pump 34 empties the liquid 24 from the pool 14 exposing the gravel layer 36 which, under normal circumstances, is completely covered by the liquid 24. The invention thus allows rapid transition to a gravel or other particulate/aggregate arresting medium, and can rapidly be restored to a liquid arresting medium when the pump 34 refills the pool 14 with liquid 24. If desired, additional gravel can be temporarily spread over layer 36 for motorcycle races, and removed before the liquid is returned to the pool for car races. When the arresting medium is liquid 24, ejection of gravel is prevented by the liquid 24 slowing and stopping any displaced particles.

The crash barrier 20, in this example, is of the standard variety found on racetracks and along normal roads. It is of the "Armco"™ variety and consists in metal plates, curved for increased strength, held on posts 22, which may or may not be specially adapted to shear or bend. The invention permits the crash barrier to be of any form, and can include tyre walls, collapsible solid foam, air cushions and any other device known to act as a crash barrier.

Figure 3:
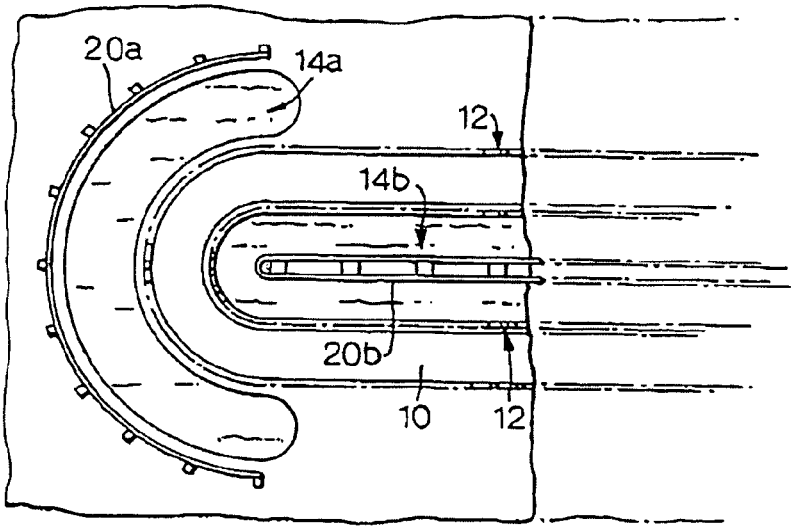
FIG. 3 is a plan view of an alternative embodiment of the invention, suitable for use in a double portion of track.

Attention is drawn to FIG. 3 showing a variant of the present invention. The track 10 is shown as a stylised hairpin bend, found on many vehicle racing circuits, In the conventional way, according to FIGS. 1 and 2, a pool 14*a* surrounds the corner of the hairpin. A variant is shown between the two legs of the track 10 approaching and departing from the hairpin bend. A pool 14*b* is provided there between, but having a common crash barrier 20*b*, in the centre of the pool 14*b*. Such an arrangement could equally be applied to separate adjacent carriageway highways and motorways.

In the previous description of the invention, the arresting medium has been indicated as liquid 24. The preferred liquid is water. The liquid 24 can equally be fire retardant oils and liquid foams, or combinations of liquids, which create fire resistant foam, when agitated. Water is preferred because of its ready availability and non-toxicity. The invention permits the addition of active biocidal substances to the water to prevent biological activity in the pond, such as weed, slime and moss inhibitors, and insecticides to inhibit mosquitoes and pond living vertebrates and invertebrates. The invention also encompasses the addition of an anti-gelling agent to prevent the water from freezing during cold weather.

The invention also proposes that the pool 14 can be effectively self-filling by accepting water which runs off from the track 10. This is of especial effectiveness on highways or motorways, where the pump 34 can be used to remove excess water, which occurs during periods of excessive or intense rainfall.

The invention has been described with reference to use on only one side of a straight track 10, and both sides of a curved track. It is to be appreciated that the invention can be employed on both sides of a straight track 10, especially where the track is an aircraft runway.

What is claimed is:

1. A method for slowing the progress of a vehicle which has departed a track with a component of velocity transverse to the direction of the track, said method comprising: providing a pool of liquid beside the track; said pool extending in the direction of the track and extending transversely to the direction of the track; said pool comprising a shaped base; said liquid being contained within said base; said base being shaped for said liquid to increase in depth with increasing transverse distance from the track for at least an initial portion of the distance from the track; and the extent of said pool being sufficient in said direction and the extent of said pool being sufficient in the direction transverse to the direction of the track to slow a vehicle within said pool when a vehicle engages said liquid; and slowing the progress of a vehicle which has departed the track by causing said vehicle to enter the pool and engage said liquid.

2. A method according to claim 1 further comprising maintaining said liquid at a predetermined maximum depth, said maximum depth being sufficiently shallow to allow powered movement of an upright vehicle in said pool and sufficiently shallow to prevent drowning of a driver in an overturned vehicle.

3. A method according to claim 2, wherein said predetermined maximum depth is in the range 20 cm to 40 cm.

4. A method according to claim 1, further comprising providing a crash barrier to prevent a vehicle exiting said pool in the event that the vehicle has failed to be stopped within said pool.

5. A method according to claim 1, wherein said base comprises an impermeable membrane adjacent to the surface of a depression in a substrate, said depression being of substantially the same shape and dimensions as said pool, and a hard layer, covering said membrane, said hard layer being of sufficient strength to support vehicles in said pool.

6. A method according to claim 5, wherein said membrane includes a butyl rubber membrane.

7. A method according to claim 5, wherein said hard layer is a concrete layer.

8. A method according to claim 1, further comprising providing a pump for altering the amount of said liquid in said pool.

9. A method according to claim 5, further comprising providing a pump for altering the amount of said liquid in said pool.

10. A method according to claim 9, further comprising providing a layer of particulate material resting on said hard layer and submerged beneath said liquid when said pool is full, said pump being operative to empty said liquid from said pool to permit said apparatus to employ said particulate material as a vehicle arresting medium in preference to said liquid.

11. A method according to claim 8, comprising operating said pump to introduce liquid into said pool.

12. A method according to claim 10, comprising operating said pump to introduce liquid into said pool.

13. A method according to claim 10, wherein said particulate material is gravel.

14. A method according to claim 1, wherein said liquid is water.

15. A method according to claim 4, wherein said water contains at least one additive to tower the freezing point of said water.

16. A method according to claim 4, wherein said water contains at least one additive to prevent biological growth in said water.

17. A method according to claim 1, wherein said pool is of sufficient extent to stop a vehicle within said pool.

18. A method according to claim 4, wherein said base comprises an impermeable membrane adjacent to the surface of a depression in a substrate, said depression being of substantially the same shape and dimensions as said pool, and a hard layer, covering said membrane, said hard layer being of sufficient strength to support vehicles in said pool.

19. A method according to claim 1, wherein said pool extends transversely to the direction of the track for at least a distance equal to a length of a typical racing car.

20. A method according to claim 2, wherein said pool extends transversely to the direction of the track for at least four meters.

21. A method for slowing the progress of a vehicle which has departed a track with a component of velocity transverse to the direction of the track, said method comprising: providing a pool of liquid beside the track; said pool extending in the direction of the track and extending transversely to the direction of the track; said pool comprising a shaped base; said liquid being contained within said base; said base being shaped for said liquid to increase in depth with increasing transverse distance from the track for at least an initial portion of the distance from the track; and the extent of said pool being sufficient in said direction and the extent of said pool being sufficient in the direction transverse to the direction of the track to slow a vehicle within said pool when a vehicle engages said liquid; and slowing the progress of a vehicle which has departed the track by causing said vehicle to enter the pool and engage said liquid while permitting the vehicle to steer back onto the track out of the liquid.

* * * * *